US008919253B2

(12) United States Patent
Sampson et al.

(10) Patent No.: US 8,919,253 B2
(45) Date of Patent: Dec. 30, 2014

(54) PERFORATING STRING WITH MAGNETOHYDRODYNAMIC INITIATION TRANSFER

(75) Inventors: Tim W. Sampson, Tomball, TX (US); William Harvey, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 811 days.

(21) Appl. No.: 13/116,700

(22) Filed: May 26, 2011

(65) Prior Publication Data

US 2012/0298363 A1 Nov. 29, 2012

(51) Int. Cl.
*E21B 43/11* (2006.01)
*E21B 43/1185* (2006.01)

(52) U.S. Cl.
CPC ..... *E21B 43/1185* (2013.01)
USPC ..... 102/310; 102/200; 102/206; 102/207; 102/209; 89/1.15; 175/4.6; 361/248

(58) Field of Classification Search
USPC ..... 102/306, 307, 308, 309, 310, 200, 102/202.5, 202.7, 202.11, 206, 207, 209; 89/1.5; 175/4.6; 361/248, 251; 166/298, 55.1
See application file for complete search history.

(56) References Cited

U.S. PATENT DOCUMENTS

| | | | | |
|---|---|---|---|---|
| 2,970,545 A | | 2/1961 | Howe | |
| 3,348,079 A | * | 10/1967 | McKinnon | 310/11 |
| 3,741,124 A | | 6/1973 | Visk | |
| 3,826,451 A | * | 7/1974 | Grantham | 244/158.1 |
| 4,031,826 A | | 6/1977 | Gemmell et al. | |
| 4,085,679 A | * | 4/1978 | Webb et al. | 102/256 |
| 4,121,123 A | * | 10/1978 | Crolius | 310/10 |
| 4,370,576 A | | 1/1983 | Foster, Jr. et al. | |
| H148 H | * | 11/1986 | Thompson | 89/8 |
| 4,852,494 A | | 8/1989 | Williams | |
| 4,862,021 A | | 8/1989 | LaRocca | |
| 5,123,356 A | | 6/1992 | Brooks et al. | |
| 5,323,855 A | | 6/1994 | Evans | |
| 5,377,592 A | | 1/1995 | Rode et al. | |
| 5,435,248 A | | 7/1995 | Rode et al. | |
| 5,505,134 A | | 4/1996 | Brooks et al. | |

(Continued)

FOREIGN PATENT DOCUMENTS

| | | |
|---|---|---|
| CN | 201236684 | 5/2009 |
| JP | 05-227732 A | 9/1993 |

OTHER PUBLICATIONS

Article, E-BOMB, Popular Mechanics, Sep. 2001.

(Continued)

*Primary Examiner* — James S Bergin
(74) *Attorney, Agent, or Firm* — Bracewell & Giuliani LLP

(57) ABSTRACT

A perforating system that transfers a detonation wave between adjacent perforating guns by converting shockwave energy to electrical energy. An explosive is provided on an end of a detonating cord that is coupled to shaped charges, so that a detonation wave traveling in the detonation cord will initiate detonation in the shaped charges and then in the high explosive. The explosive is disposed adjacent a pair of members that are energized so that a magnetic field is formed between the members. When the explosive detonates, the resulting shock wave pushes one of the members into the space between the members to compress the magnetic field. Compressing the magnetic field produces an electrical potential usable to initiate a detonation wave in another detonating cord for perpetuating the detonation wave along the perforating system.

8 Claims, 4 Drawing Sheets

(56) References Cited

U.S. PATENT DOCUMENTS

| | | | | |
|---|---|---|---|---|
| 6,311,621 | B1 | 11/2001 | Marshall et al. | |
| 6,386,108 | B1 * | 5/2002 | Brooks et al. | 102/217 |
| 7,276,819 | B1 | 10/2007 | Whitley | |
| 7,387,162 | B2 | 6/2008 | Mooney, Jr. et al. | |
| 7,721,650 | B2 | 5/2010 | Barton et al. | |
| 2009/0084535 | A1 | 4/2009 | Bertoja et al. | |
| 2010/0000789 | A1 | 1/2010 | Barton | |
| 2011/0024116 | A1 | 2/2011 | McCann | |

OTHER PUBLICATIONS

International Search Report and The Written Opinion of the International Searching Authority dated Nov. 23, 2012; International Application No. PCT/US2012/038952, International Filing Date: May 22, 2012.

* cited by examiner

PERFORATING STRING WITH MAGNETOHYDRODYNAMIC INITIATION TRANSFER

BACKGROUND

1. Field of Invention

The invention relates generally to the field of oil and gas production. More specifically, the present invention relates to an initiation transfer between perforating guns in a perforating string.

2. Description of Prior Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore. The casing is retained in the wellbore by pumping cement into the annular space between the wellbore and the casing. The cemented casing is provided in the wellbore for the specific purpose of hydraulically isolating from each other the various earth formations penetrated by the wellbore.

Perforating systems typically comprise one or more perforating guns strung together, these strings of guns can sometimes surpass a thousand feet of perforating length. In FIG. 1 a prior art perforating system 11 is shown having a perforating gun string 4 with perforating guns 6. The gun string 4 is shown disposed within a wellbore 1 on a wireline 5. The perforating guns 6 in the gun string 4 are usually coupled together by connector subs 13. A service truck 7 on the surface 9 generally accompanies perforating systems 11 for handling the upper end of the wireline 5. The wireline 5 typically is used for raising and lowering the gun string 4, as well as a communication means and control signal path between the truck 7 and the perforating gun 6. The wireline 5 is generally threaded through pulleys 3 supported above the wellbore 1. As is known, derricks, slips and other similar systems may be used in lieu of a surface truck for inserting and retrieving the perforating system into and from a wellbore. Moreover, perforating systems are also disposed into a wellbore via tubing, drill pipe, slick line, and/or coiled tubing.

Included with the perforating gun 6 are shaped charges 8 that typically include a housing, a liner, and a quantity of high explosive inserted between the liner and the housing. When the high explosive is detonated, the force of the detonation collapses the liner and ejects it from one end of the charge 8 at very high velocity in a pattern called a "jet" 12. The jet 12 perforates the casing and the cement and creates a perforation 10 that extends into the surrounding formation 2.

FIG. 2 is a prior art example of a portion of a perforating string 4 showing a connection between a connector sub 13 and perforating gun 6. A typical way of transferring a detonation wave between adjacent members of a perforating string 4 involves providing a detonating cord 15, and attaching a transfer charge 17 on its lower end that is oriented towards the perforating gun 6. A solid bulkhead 19 may sometimes be provided in the connection between adjacent members of a perforating string 4. To transfer the detonation wave into the perforating gun 6, a booster charge 21 is often set within the perforating gun 6 that faces the transfer charge 17. Per design, a jet (not shown) forms upon detonation of the transfer charge 17 that penetrates the bulkhead 19 to detonate the booster charge 21. This perpetuates travel of the detonation wave from the perforating cord 15 and the connecting sub 13 to the perforating cord 15 within the perforating gun 6.

Shaped charges 8 are generally positioned adjacent the perforating cord 15, each having high explosive that explodes in response to the detonation wave traveling along the perforating cord 15.

As shown in a side sectional view in FIG. 3, in some instances adjacent perforating members 6A, 13A in a perforating string 4A may pivot with respect to one another and be oriented at an angle oblique to one another. This is sometimes accomplished by providing a spherically-shaped ball end 23, which is shown on the upper end of the perforating gun 6A, and mating the ball end 23 with a socket end 25, shown on the lower end of the connector sub 13A. The socket end 25, which is also spherically-shaped to accommodate the profile of the ball end 23, allows a pivoting action of the two perforating string members 6A, 13A. Problems associated with current transfer mechanisms include the bulkhead 19 blocking or substantially hindering the jet from the transfer charge 17 so that an insufficient amount of energy in the jet to detonate the booster charge 21. Such an instance halts transfer of the detonation wave into any perforating cord(s) 15 lower in the perforating string 4A. The swiveling connections of FIG. 2 also pose a problem in that the pivoting sometimes moves the booster charge 21 out of the path of the jet formed by the transfer charge 17, which also prevents further travel of the detonation wave within the perforating string.

SUMMARY OF INVENTION

Disclosed herein are examples of a system and method for perforating a wellbore. In an example embodiment disclosed is a perforating system made up of a perforating string of elongated bodies connected in series. Shaped charges and a detonating cord for detonating the shaped charges are provided in one of the elongated bodies. Also included in the body is a pair of conductive members that are separated by a space. An explosive is disposed on an end of the detonating cord and set adjacent one of the conductive members. The explosive is on a side of one of the members opposite the space. Also included is an electrical detonator that is electrically connected to the conductive members. When electricity flows through the members, a magnetic field forms in the space. Further, when a detonation wave from the detonating cord detonates the high explosive, the force of the detonation pushes one of the conductive members into the space. By projecting one of the members towards the other, the magnetic field is compressed that in turn generates an electrical current, where the current flows to the electrical detonator for initiating the detonator. The elongated bodies can be one of a perforating gun, a firing head, or a connecting sub. In an example embodiment, the conductive members are concentric tubulars, where one is an inner tubular and the other is an outer tubular, wherein the high explosive is set within the inner tubular. In an example embodiment, the elongated body is a first elongated body, in this example the system also includes a connector mounted on an end of the first elongated body and a second elongated body mounted on an end of the connector opposite the first elongated body. The explosive is disposed in the connector and the electrical detonator is disposed in the second elongated body. In an example embodiment, the detonating cord is a first detonating cord and wherein the electrical detonator is attached to a second detonating cord that extends adjacent shaped charges disposed in the second elongated body. In an example embodiment, the system further includes a battery and a capacitor that is charged by the battery. The capacitor connects to the conductive members for providing electricity to the members. In an example embodiment, the electrical detonator is in another one of the elongated bodies and wherein a pressure terminal is disposed in the another one of the elongated bodies. In this configuration, conducting leads for electrically communicating the electrical detonator with the conductive members extend through the pressure terminal.

Also included in this present disclosure is a method of transferring a detonation wave between adjacent bodies in a perforating string. In an example embodiment, the method includes energizing a pair of electrically conducting members to form a magnetic field in a space between the two members. An explosive is provided on an end of a detonating cord and disposed adjacent one of the conductive members. A detonation wave is initiated in the detonating cord that detonates the explosive. The blast from the explosive urges the one of the conductive members into the space and compresses the magnetic field. Compressing the magnetic field forms another flow of electricity that is greater than that used to form the magnetic field. The increased flow of electricity is sent to an electrical detonator along a path that extends through a connection that connects the body having the detonating cord with another body in the perforating string that is adjacent the body. In an example embodiment, the detonation wave initiates detonation of shaped charges in the body of the perforating string having the explosive. Wherein the electrical detonator uses the electricity that flows through the connection to initiate a detonation wave in a detonating cord in the body of the perforating string having the electrical detonator. In an example embodiment, flowing electricity through the members includes connecting an electrical power source to both members and connecting both members to the electrical detonator through the connection between the bodies. Connection to the electrical detonator completes an electrical circuit for providing electrical flow through the members and to and from the electrical power source. In an example embodiment, the conductive members are annular and wherein one of the members circumscribes the other. In an example embodiment, the steps of energizing a pair of electrically conducting members and providing an explosive on an end of a detonation cord is repeated. A detonation wave is initiated in the detonating cord in the adjacent body by directing the increased flow of electricity to the electronic detonator. Also, the increased flow of electricity is flowed through a connection connecting the adjacent body in the perforating string with a second adjacent body in the perforating string, and to an electrical detonator disposed in the second adjacent body in the perforating string. In an example embodiment, the body in the perforating string having the detonating cord is a connector sub having an end distal from the connection coupled with a perforating gun body.

BRIEF DESCRIPTION OF DRAWINGS

Some of the features and benefits of the present invention having been stated, others will become apparent as the description proceeds when taken in conjunction with the accompanying drawings, in which.

Figure 1:
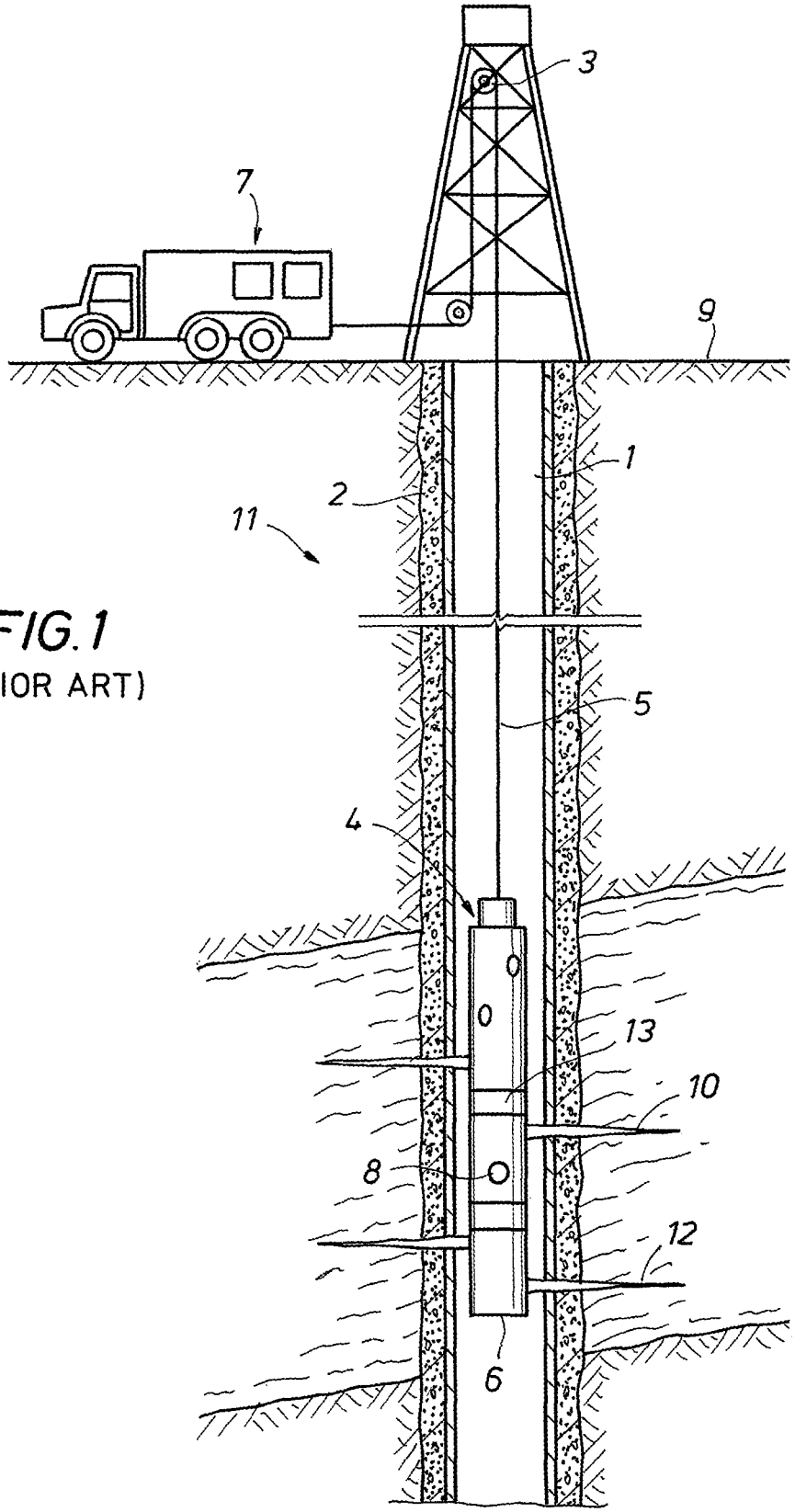
FIG. 1 (PRIOR ART)
FIG. 1 is a side partial sectional view of a prior art perforating system used for perforating a wellbore.
Figure 2:
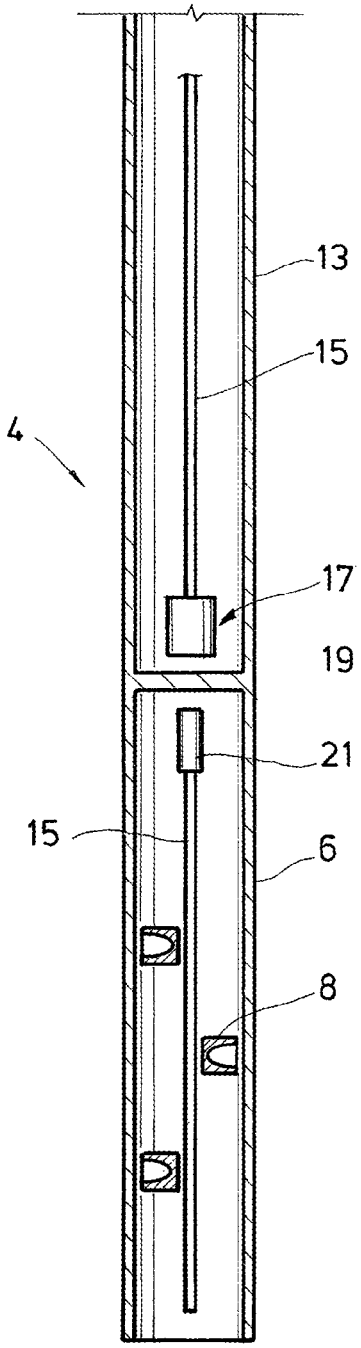
FIG. 2 (PRIOR ART)
FIGS. 2 and 3 are side sectional views of adjacent members of a prior art perforating system.
Figure 3:
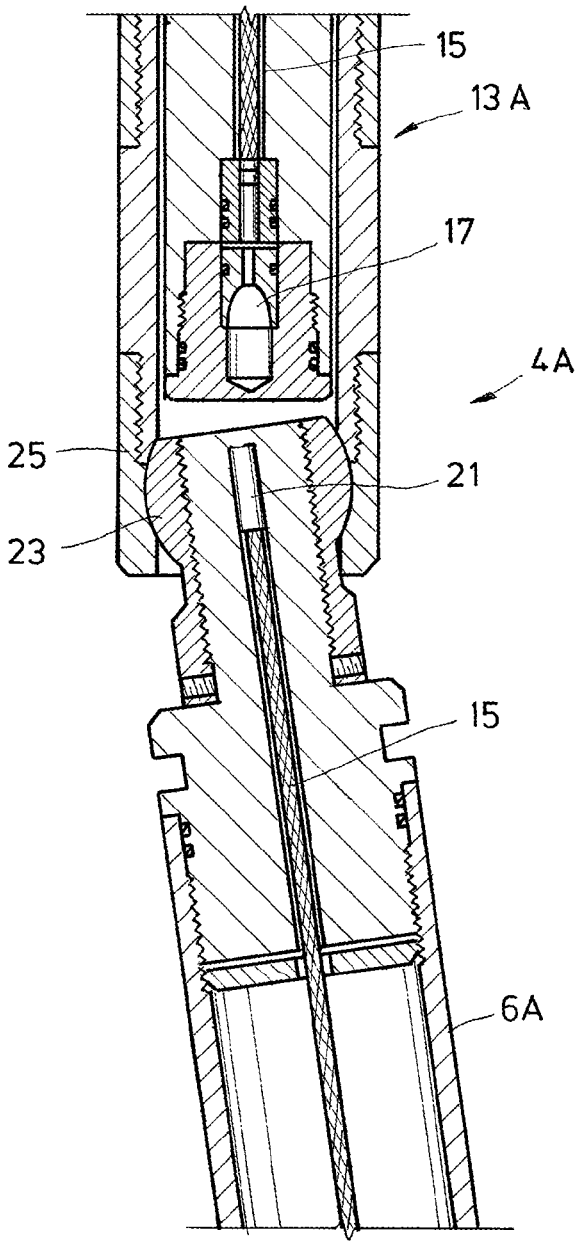
FIG. 3 (PRIOR ART)

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation. Accordingly, the improvements herein described are therefore to be limited only by the scope of the appended claims.

Figure 4:
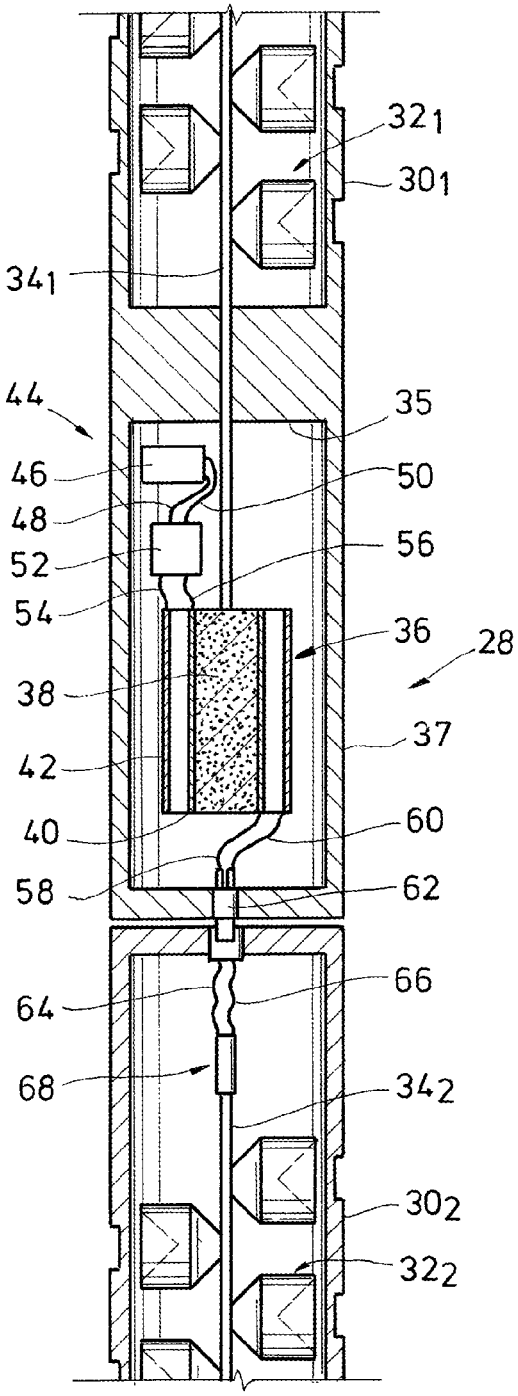
FIG. 4 is a side sectional view of a portion of a perforating system in accordance with the present invention.

Shown in a partial side sectional view in FIG. 4 is an example embodiment of a portion of a gun string 28 having perforating guns $\mathbf{30}_1$, $\mathbf{30}_2$ with shaped charges $\mathbf{32}_1$, $\mathbf{32}_2$ set within. Coupled to the shaped charges $\mathbf{32}_1$, $\mathbf{32}_2$ are detonating cords $\mathbf{34}_1$, $\mathbf{34}_2$ that when initiated deliver a detonation wave to detonate the shaped charges $\mathbf{32}_1$, $\mathbf{32}_2$. Shown between the adjacent perforating guns $\mathbf{30}_1$, $\mathbf{30}_2$ is an example embodiment of a ballistic conversion device 36 disposed within a connector sub 37 that couples the adjacent perforating guns $\mathbf{30}_1$, $\mathbf{30}_2$. The ballistic conversion device 36 of FIG. 4 includes an energetic material 38 provided within an annular inner tube 40 shown circumscribed by an outer tube 42. The energetic material 38 includes anything that can rapidly expand in a medium, where the expansion rate can be at about the sound speed of the medium, above the sound speed of the medium, or below the sound speed of the medium. The rapid expansion can occur from a reaction of the energetic material 38, such as an explosion, combustion, deflagration, or detonation. Examples of energetic material include an explosive, a propellant, and oxidizer, a high explosive (such as RDX, HMX, or HNS), combinations thereof, and the like. In an example embodiment, the inner and outer tubes 40, 42 are electrically conductive and respectively in electrical communication with a power supply 44. The power supply 44 of FIG. 4 includes a battery 46 with leads 48, 50 connecting to a capacitor 52. Where the capacitor 52 is chargeable by selectively flowing electricity from the battery 46 through leads 48, 50. Leads 48, 50 provide electrical communication between the capacitor 52 and the inner and outer tubes 40, 42.

Additional leads 58, 60 are shown that respectively connect the inner and outer tubes 40, 42 to a pressure terminal 62 shown extending between a lower end of the connector sub 37 and upper end of the perforating gun $\mathbf{30}_2$. Leads 64, 66 extend from an end of the pressure terminal 62 within the perforating gun $30_2$ and into connection with an electrical detonator 68 shown attached to an upper end of detonation cord $34_2$. The detonator 68 may be equipped with a resistor (not shown) so that when an electrical potential below a threshold value is applied across the leads 64, 66, a current flows through the resistor to enable electrical flow through the leads 64, 66. In contrast, applying an electrical potential above a threshold value causes the electrical detonator 68 to initiate a detonation wave in the detonation cord $34_2$. The threshold value is dependent on the particular electrical detonator and may be determined by those skilled in the art without undue experimentation.

Figure 5:
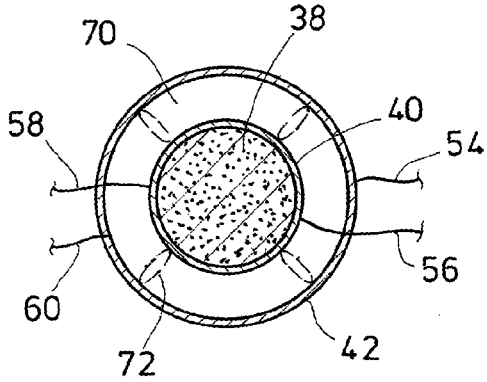
FIG. 5 is an axial sectional view of magnetohydrodynamic portion of the perforating system of FIG. 4.
Figure 6:
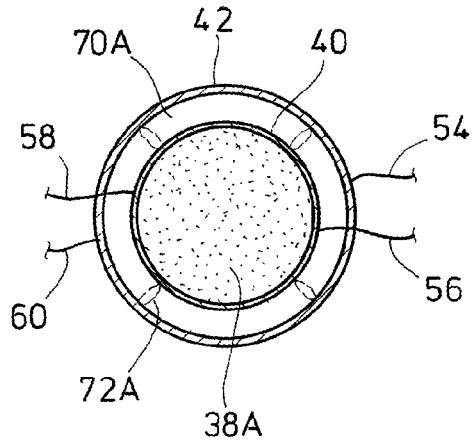
FIG. 6 is a view of the portion of FIG. 5 during radial expansion of an inner tubular.

Referring now to FIGS. 5 and 6, illustrated is an example of operation of transferring a detonation wave through the connection between the connector sub 37 and the perforating gun $30_2$. An electrical circuit may be formed by connecting the power source, inner and outer tubes 40, 42, and electrical detonator 68 as shown in the example of FIG. 4. The capacitor 52 is charged with electricity flowing from the battery through the leads 58, 60. A switch (not shown) may be included in one or both of the leads 54, 56, that is closed at a designated time to discharge electricity in the capacitor 52 that flows through the inner and outer tubes 40, 42 and electrical detonator 68. As shown in FIG. 5, the inner and outer tubes 40, 42 are separated by an annular space 72 and at a distance so that electrical flow through the inner and outer tubes 40, 42 generates a magnetic field 72 in the space. While the magnetic field 72 is being generated, a detonation wave is initiated in the detonation cord $34_1$ in the upper perforating gun $30_1$ to detonate the shaped charges $32_1$. The detonation wave travels along the detonation cord $34_1$ and through the blast shield 35 to detonate the energetic material 38.

As shown in FIG. 6, the detonating energetic material 38A expands radially outward to push the inner tube 40A radially outward as well and reduces the volume of the space 70A. The sudden violent movement of the inner tube 40A encroaching into the space 70A compresses the magnetic field 72A. The change of the magnetic field 72 to a compressed magnetic field 72A generates an additional amount of electrical current flow through the above described circuit, that when directed to the electrical detonator 68 is above the threshold value for initiating detonation of the detonation cord $34_2$. As such, the energy of the detonation wave in the detonation cord $34_1$ is transferred to a subsequently disposed perforating gun in a non-ballistic form. Thus one of the advantages of the method and system described herein is the ability to transfer energy for detonating shaped charges between adjacent bodies of a perforating string in a form that does not require that adjacent bodies be in a particular orientation.

Figure 7:
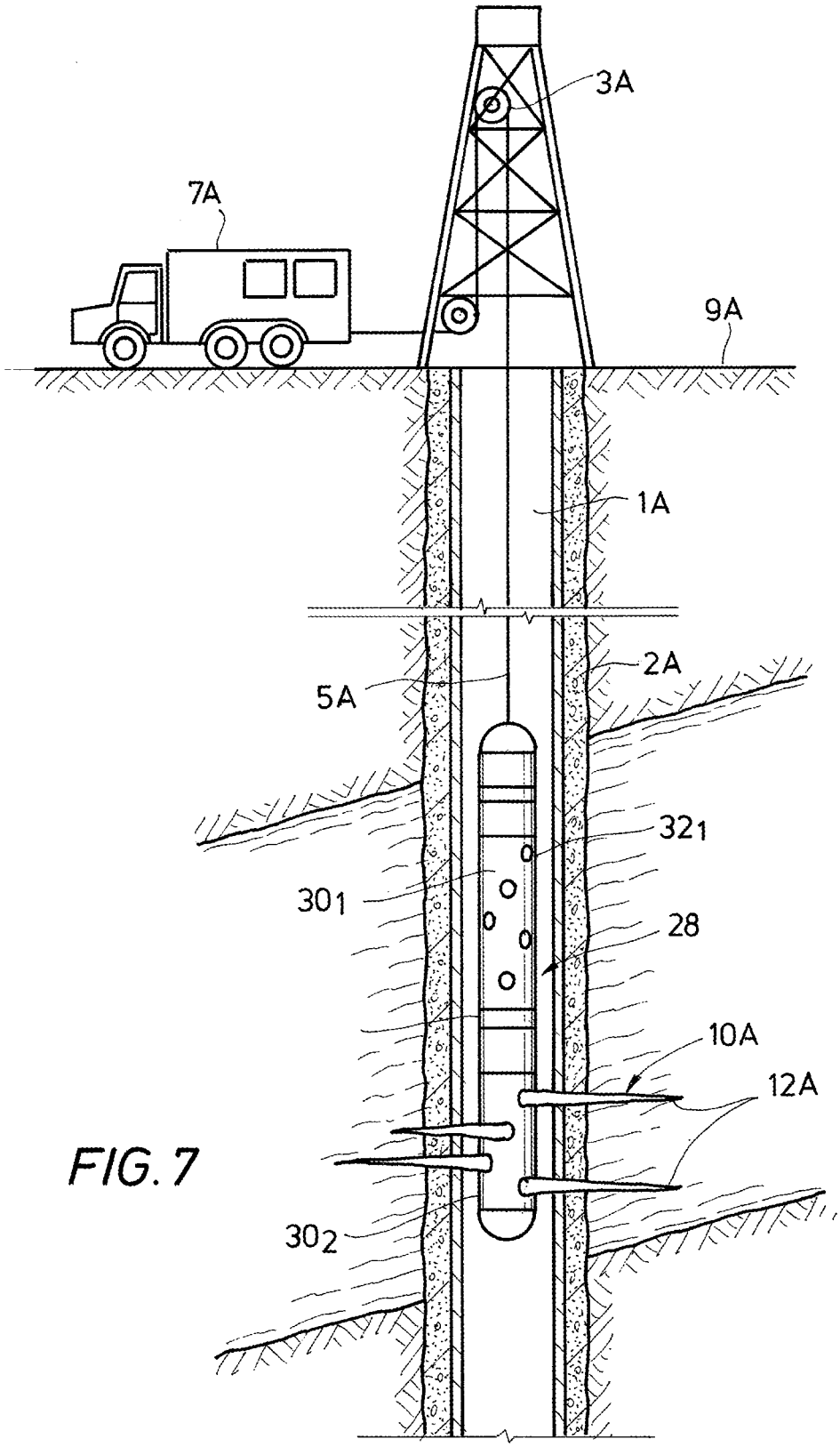
FIG. 7 is an example embodiment of a perforating system perforating a wellbore in accordance with the present invention.

Referring now to FIG. 7, a partial side view is provided of the perforating string 28 shown within a wellbore 1A and deployed on a deployment means 5A. Detonation signals may be initiated from a surface truck 7A shown above the opening of the wellbore 1A and through the deployment means 5A. In examples where the deployment means 5A is a wireline, the wireline may be looped through pulleys 3A on the surface 9A. In examples where the deployment means is coiled tubing, a spool (not shown) may be provided on surface for providing an amount of tubing for insertion into the wellbore 1A. A detonation signal can be delivered to the perforating string 28 via the deployment means 5A for activating an electrical detonator to initiate a detonation wave in a detonating cord. This in turn detonates shaped charges $32_1$ in the perforating guns $30_1$ to form the jets 12A. Directing the jets 12A into the formation 2A forms perforations 10A in the formation 2A and adjacent the wellbore 1A.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, in an example embodiment, the term magnetohydrodynamic (MHD) effect may be used to describe the phenomenon of generating electrical current flow by compressing a magnetic field. Similarly, the ballistic conversion device 36 may be referred to as a magnetohydrodynamic device. These and other similar modifications will readily suggest themselves to those skilled in the art, and are intended to be encompassed within the spirit of the present invention disclosed herein and the scope of the appended claims.

What is claimed is:

1. A perforating system comprising:

a perforating string of elongated bodies connected in series;

shaped charges in a one of the elongated bodies;

a detonating cord for detonating the shaped charges in the one of the elongated bodies;

a pair of conductive members separated by a space in the one of the elongated bodies;

an energetic material in initiating communication with the detonating cord and disposed adjacent one of the conductive members and on a side opposite the space; and an electrical detonator in electrical communication with the conductive members, so that when electricity flows in the members a magnetic field is formed in the space and when a detonation wave from the detonating cord reacts the energetic material to push the adjacent one of the conductive members into the space and compresses the magnetic field thereby generating an electrical current that flows to the electrical detonator.

2. The perforating system of claim 1, wherein the elongated bodies are selected from a group consisting of a perforating gun, a firing head, and a connecting sub.

3. The perforating system of claim 1, wherein the energetic material comprises a reactive material that is selected from the group consisting of explosive, high explosive, propellant, an oxidizer, and combinations thereof.

4. The perforating system of claim 1, wherein the conductive members comprise concentric tubulars to define an inner tubular and an outer tubular, and wherein the energetic material is set within the inner tubular.

5. The perforating system of claim 1, wherein the elongated body comprises a first elongated body, the system further comprising a connector mounted on an end of the first elongated body and a second elongated body mounted on an end of the connector opposite the first elongated body and wherein the energetic material is disposed in the connector and the electrical detonator is disposed in the second elongated body.

6. The perforating system of claim 5, wherein the detonating cord comprises a first detonating cord and wherein the electrical detonator is attached to a second detonating cord that extends adjacent shaped charges disposed in the second elongated body.

7. The perforating system of claim 1, further comprising a battery and a capacitor selectively charged by the battery and that is selectively in electrical communication with the conductive members.

8. The perforating system of claim 1, wherein the electrical detonator is in another one of the elongated bodies and wherein a pressure terminal is disposed in the another one of the elongated bodies, wherein conducting leads for electrically communicating the electrical detonator with the conductive members extend through the pressure terminal.

* * * * *